US006491375B1

(12) United States Patent
Fitch

(10) Patent No.: US 6,491,375 B1
(45) Date of Patent: Dec. 10, 2002

(54) INTEGRATED PRINTHEAD

(75) Inventor: John S. Fitch, Los Altos, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/440,033

(22) Filed: Nov. 12, 1999

(51) Int. Cl.[7] ..... B41J 2/135
(52) U.S. Cl. ..... 347/46
(58) Field of Search ..... 347/55, 54, 50, 347/46, 44, 20

(56) References Cited

U.S. PATENT DOCUMENTS 4,347,524 A * 8/1982 Engel et al. ..... 347/94
4,415,910 A * 11/1983 Reece ..... 347/54
5,612,723 A * 3/1997 Shimura et al. ..... 347/46
5,684,519 A * 11/1997 Matoba et al. ..... 347/20
6,074,043 A * 6/2000 Ahn ..... 347/54
6,154,236 A * 11/2000 Roy et al. ..... 347/46
6,315,394 B1 * 11/2001 Fujii ..... 347/54

* cited by examiner

*Primary Examiner*—John S. Hilten
*Assistant Examiner*—K. Feggins
(74) *Attorney, Agent, or Firm*—Fay, Sharpe, Fagan, Minnich & McKee, LLP

(57) ABSTRACT

An integrated printhead package for acoustic ink printing includes a plurality of layers. Each of the layers is stacked against one of the other layers. A reservoir is defined within the layers and contains a first fluid. One of the layers forms a plate for covering an open side of the reservoir. The plate has apertures for passing the first fluid from the reservoir to an exterior area. A passage, formed by at least one of the stacked layers, communicates with the reservoir and the exterior area. The first fluid passes through the passage. At least one of a pressure sensor and a temperature sensor are located within the layers. The pressure sensor and temperature sensor measures a pressure and temperature, respectively, of the first fluid.

22 Claims, 5 Drawing Sheets

INTEGRATED PRINTHEAD

BACKGROUND OF THE INVENTION

The present invention relates to printheads used with ink printers. It finds particular application in conjunction with printheads used with acoustic ink printers, and will be described with particular reference thereto. It will be appreciated, however, that the invention will also find application in printheads used with other types of ink printers, and the like.

In acoustic ink printing, acoustic radiation by an ejector is used to eject individual droplets on demand from a free ink surface (i.e., the Liquid/air interface). Typically, several ejectors are arranged in a linear or two-dimensional array in a printhead. The ejectors eject droplets at a sufficient velocity in a pattern so that the ink droplets are deposited on a nearby recording medium in the shape of an image.

Heretofore, acoustic ink printheads incorporate several different components. More specifically, they incorporate electrical components to supply power to the printhead, acoustic components to produce the acoustic radiation within the printhead, structural components to define and maintain the framework of the printhead, and fluidic components to flow ink, coolants, and/or other liquids through the printhead.

In conventional printheads, each of the components is a separate and independent element. Each of the independent components is combined to form a stand-alone printhead.

To illustrate the component-based design of the conventional printhead, one method of producing a traditional printhead is discussed. The first step includes stamping different hole patterns into several pieces of two-dimensional sheet metal. The two-dimensional metal sheets are then stacked on top of one another in an aligned design. The sheets are secured to one another using a brazed metal, thereby creating a three-dimensional structure. A glass acoustic transducer, an aperture plate, along with fluidic components and connections, are then secured to the three-dimensional structure. Wires are bonded into the structure and electrical connections are made to allow the printhead to communicate with external devices. Traditionally, the electrical connections include polyimide/copper flex, which is epoxied to the head. Wire bonds between the flex and the chips on the glass complete connections to the glass transducers.

Building printheads according to the method discussed above, which merely combines various discrete components, has at least one drawback. For example, because the reliability of the printhead is dependent upon the reliability of each of the components, the reliability of the printhead is negatively affected if any one of the components is defective. Furthermore, the number of component parts in the conventional printhead adds to the complexity and cost of the manufacturing process and, consequently, the final product.

The present invention provides a new and improved apparatus and method which overcomes the above-referenced problems and others.

SUMMARY OF THE INVENTION

An integrated printhead includes a housing and a reservoir defined in the housing. The reservoir contains a first fluid. A plate covers an open side of the reservoir. The plate has apertures for passing the first fluid from the reservoir to the exterior of the housing. A passage is formed within the housing. The passage communicates with the reservoir. A temperature sensor within the housing measures a temperature of the first fluid. A substrate, within the reservoir, causes the first fluid to be ejected from the reservoir.

In accordance with one aspect of the invention, the housing includes a ceramic material.

In accordance with another aspect of the invention, an acoustic generator, secured to the substrate, produces acoustic sound waves within the reservoir. At least one lens, secured to the substrate, focuses the acoustic sound waves toward the aperture plate. Each lens is associated with one of the acoustic generators.

In accordance with another aspect of the invention, electronics are integrated into the housing.

In accordance with a more limited aspect of the invention, an electrical connection is used for testing the electronics.

In accordance with another aspect of the invention, a second reservoir contains a gas and a portion of the fluid. The gas acts as a dampener for absorbing vibrations and shocks in the fluid.

In accordance with another aspect of the invention, a second cover surrounds the substrate. A second fluid passes through apertures in the second cover for cooling the first fluid.

In accordance with another aspect of the invention, a pressure sensor measures a pressure of the first fluid.

In accordance with another aspect of the invention, a temperature controller device, electrically connected to the temperature sensor, controls a temperature of the first fluid as a function of data received from the temperature sensor.

In accordance with another aspect of the invention, a flow controller controls a flow of the first fluid as a function of data received from a flow sensor.

One advantage of the present invention is that the number of parts within the acoustic ink printhead is reduced.

Another advantage of the present invention is that the manufacturing cost of the acoustic ink printhead is reduced.

Another advantage of the present invention is that the performance of the acoustic ink printhead is improved.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
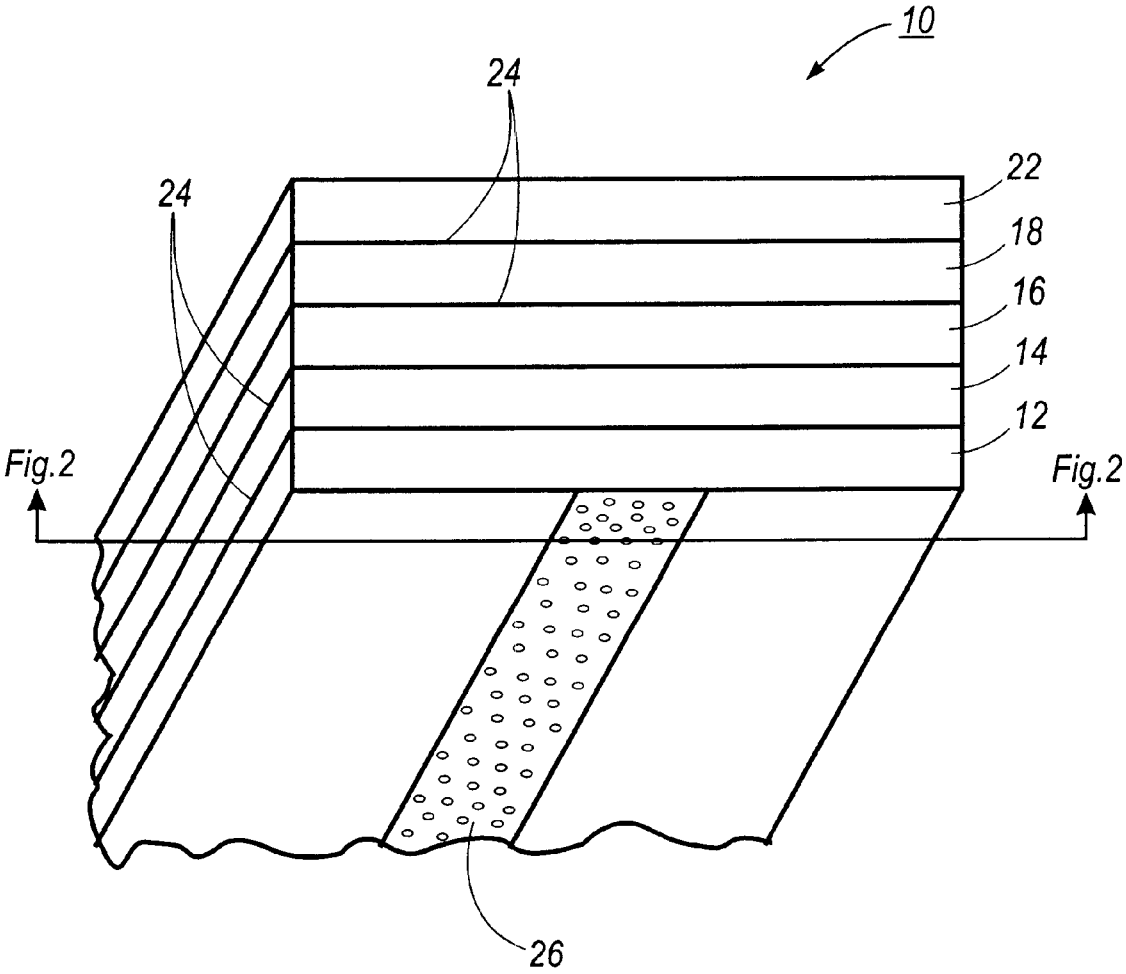
FIG. 1 illustrates a perspective view of an integrated printhead according to a first embodiment of the present invention.

With reference to FIG. 1, an integrated acoustic printhead 10 according to a first embodiment of the present invention includes five (5) layers 12, 14, 16, 18, 22 of nonconductive material. Each layer 12, 14, 16, 18, 22 preferably includes ceramic materials and is preferably secured to an adjacent layer with a brazed metal joining 24, thereby forming a panelized structure. Alternatively, an epoxy is used instead of the brazed metal. Although a ceramic material is contemplated in the preferred embodiment, it is also contemplated that the layers include other materials such as glass and/or silicon.

An aperture plate 26 is secured to the bottom layer 12 of the integrated printhead 10. Preferably, the aperture plate 26 includes a metal material (e.g., alloy 42 with nickel and/or gold plating), which is brazed onto the ceramic material of the bottom layer 12. While the preferred embodiment is described with reference to specific materials, it is to be understood that alternate embodiments, which use other materials to construct the integrated printhead, are also contemplated.

For example, it is also contemplated that the layers of the printhead include double-shot plastic molding. The double-shot plastic molding is made from two (2) intertwined networks of plastic. One of the plastics is "plateable," which allows surface traces to be plated on the plastic for creating electrical connections. Double-shot plastic molding is an attractive alternative to ceramic because it results in an inexpensive electrical package. One drawback, however, to using double-shot plastic molding is that it has different thermal expansion properties than some other component materials (e.g., glass), which are typically incorporated into acoustic printheads.

It is also contemplated that the layers of the integrated acoustic printhead include laminated printed circuit boards ("PCB"). Laminated PCB, however, suffers from the same drawback as double-shot plastic molding in that it has different expansion properties from other components (e.g., glass), which are typically integrated into the acoustic printhead. If laminated PCB is used, however, a support ring of, for example, alloy 42 may be incorporated to support such components as glass.

It is also contemplated that the layers of the integrated printhead include molded, cast, or powdered metal, which have appropriate expansion properties.

In another embodiment, the layers of the integrated printhead include molded or cast ceramic material. However, one drawback of molded or cast ceramic material is that interior passages are difficult to construct in a single molding operation. Therefore, two (2) separate parts must be independently molded and adhered together to form such internal passages. Internal electrical passages are even more difficult to form. In fact, electrical traces are typically formed by filling punched out regions of soft "green" layers of a ceramic with a metal paste. The layers are stacked together and fired to form a three-dimensional ceramic package.

Although the integrated printhead has been described in terms of layers, it is to be understood that a single molded printhead is also contemplated.

Figure 2:
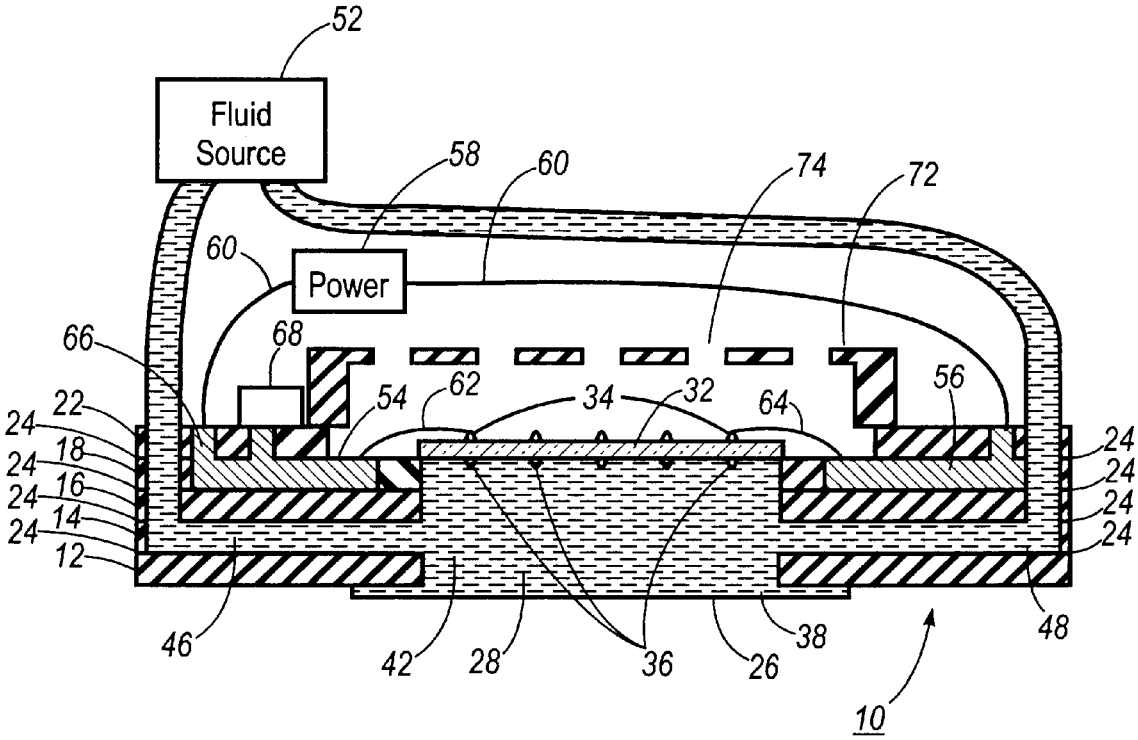
FIG. 2 illustrates a cross-sectional view of the integrated printhead shown in FIG. 1.

FIG. 2 illustrates a cross-sectional view of the integrated printhead 10 shown in FIG. 1. The layers 12, 14, 16, 18, 22 of the printhead 10 are formed to include various recesses and/or cavities. More specifically, a reservoir 28 is formed in a center portion of the printhead 10. A substrate 32 covers one side of the reservoir 28. The aperture plate 26 covers a second side of the reservoir 28. A brazed metal is preferably used to seal the substrate 32 and aperture plate 26 to the layers 12, 18, respectively. It is to be understood, however, that other sealants are also contemplated. Acoustic transducers 34, along with respective lenses 36 (e.g., Fresnel lenses), are secured to the substrate 32.

In the preferred embodiment, each transducer 34 and associated lens 36 is disposed on opposite sides of the substrate 32. The transducers 34 preferably include piezoelectric elements and the substrate 32 preferably includes a glass. In the preferred embodiment, the aperture plate 26 is spaced vertically from, and substantially parallel to, the substrate 32. However, other embodiments, in which the aperture plate is nonparallel to the substrate, are also contemplated. Such non-parallel systems may be used to compensate for ink temperature changes throughout the head. Similarly, nonparallel systems may be used to compensate for changes in the shape of the meniscus in the aperture due to pressure variations. Although the preferred embodiment includes a single reservoir, multiple reservoirs and multiple fluid passages, possibly independent of each other, are also contemplated.

Preferably, the aperture plate 26 includes a thin metal plate. However, it is to be understood that other materials are included in the aperture plate 26. The aperture plate 26 defines at least one aperture 38, which is also referred to as an ejector. Each ejector 38 is associated with one lens 36 and, therefore, one transducer 34. A fluid 42 is disposed between the aperture plate 26 and the substrate 32. Preferably, the fluid 42 includes water and at least one aqueous ink. However, it is to be understood that other fluids, including phase-change inks, are also contemplated. A space is disposed on the side of the aperture plate 26 opposite the fluid 42.

First and second reservoir passages 46, 48, respectively, provide passageways between the reservoir 28 and an external fluid source 52. First and second electrical passages 54, 56, respectively, provide electrical pathways from an external power source 58 to the transducers 34. Connectors 60 (e.g., flexes) supply power from the external power source 58 to the transducers 34 via the electrical passages 54, 56 and wires 62, 64. The electrical passages 54, 56 contain an electrically conductive material 66 for carrying signals from the external electrical source 58 to the transducers 34. The electrically conductive material 66 is preferably screened into the electrical passages 54, 56 during manufacture. The fluid 42 is circulated through the reservoir 28 from the external fluid source 52, which communicates with the first and second reservoir passages 46, 48, respectively.

An electronics package 68 is electrically connected to the first electrical passage 54. During use, the electronics package 68 sends electrical signals to the transducers 34 via the conductive material 66 in the electrical passages 54, 56. The electrical signals cause the various transducers 34 to generate acoustic sound waves into the fluid 42. The lens 36 associated with each transducer 34 focuses the respective acoustic sound wave toward one of the apertures 38, thereby causing a droplet of the fluid 42 to be ejected from the aperture 38 onto a receiving medium (not shown). This process is repeated to produce multiple droplets, and ultimately an image, on the receiving medium.

Optionally, a cooling cover 72, or alternatively a heating cover, which includes apertures 74, is integrated into the printhead 10. In the preferred embodiment, the cooling cover 72 is constructed from one layer of the ceramic material. The cooling cover 72 is secured to the printhead using the brazed metal 24. However, other embodiments, in which the cooling cover is constructed from a plurality of layers of other materials, are also contemplated. During use, an air plenum hood, cowl, or duct (not shown) is positioned over the cooling cover 72. A fluid, (e.g., air) is circulated from the hood through the apertures 74 in the cooling cover 72. The circulated air cools the substrate 32 and/or the electronics 68, thereby cooling the fluid 42. Alternatively, a cooling liquid (e.g., fluorinert) is circulated through the cooling cover. Although the cover 72 has been described in terms of circulating a cooling fluid, it is to be understood that circulating a fluid through the cover for warming the substrate, electronics, and/or the fluid 42 is also contemplated.

Figure 3:
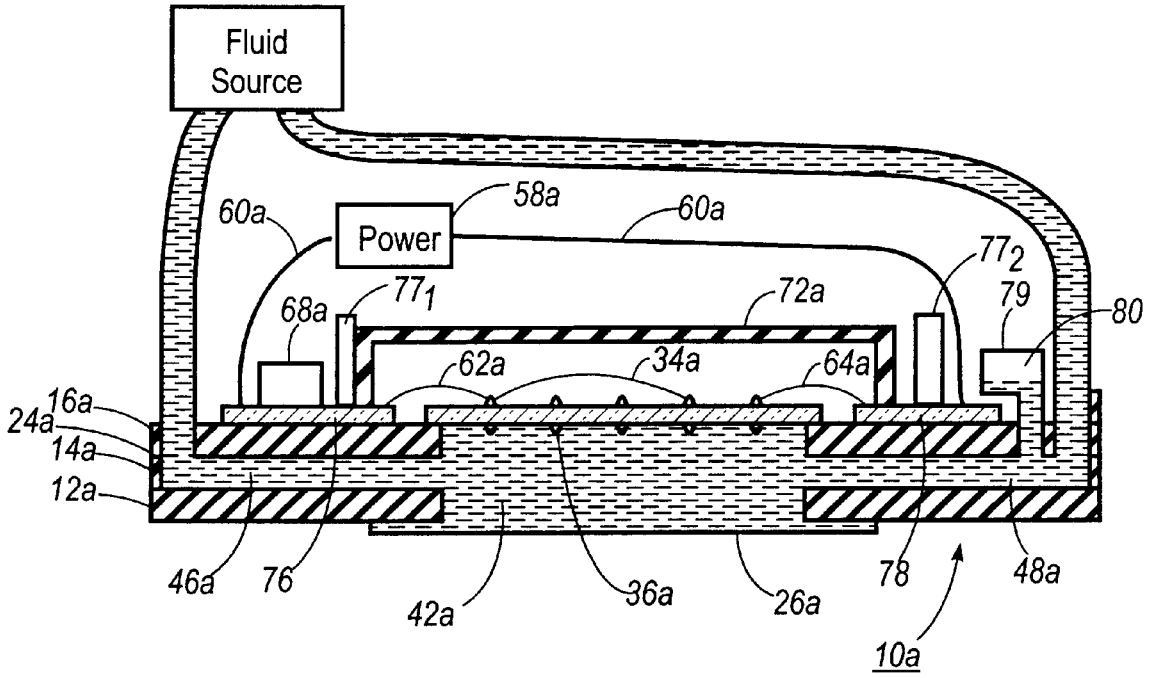
FIG. 3 illustrates a cross-sectional view of an integrated printhead according to a second embodiment of the present invention.

FIG. 3 illustrates a second embodiment of the present invention. For ease of understanding this embodiment, like components are designated by like numerals followed by an (a) and new components are designated by new numerals.

The printhead 10*a* shown in FIG. 3 includes three (3) layers 12*a*, 14*a*, 16*a* of the ceramic material. While the printhead 10*a* includes reservoir passages 46*a*, 48*a*, it does not include electronic passages. Instead, electronic pads 76, 78 are secured to the top layer 16*a* using an epoxy. Alternatively, electrical traces are formed from a screened and fired substrate such as ceramic hybrid. A PCB is also contemplated instead of epoxying traces to the ceramic material. The electronics package 68*a* is electrically and mechanically secured to the first electronic pad 76. Power is supplied to the electronic pads 76, 78 from an external electrical source 58*a* through connectors 60*a*. A first electrical connector 62*a* connects the electronics package 68*a* to the transducers 34*a*.

Optionally, a second reservoir 79 contains a gas (e.g., air) 80 and the fluid 42*a*. The air 80 acts as a dampener for absorbing vibrations and shocks in the fluid 42*a*. In this manner, the second reservoir 79 helps to prevent a phenomenon known as "water hammer."

In this embodiment, the layers 12*a*, 14*a*, 16*a* include a glass material. Prior to placing the cover 72*a* on the printhead 10*a*, and after the acoustic substrate 32*a* has been installed, the partially constructed printhead may be tested for functionality. Electrical connections $77_1$, $77_2$ are secured to the electrical pads 76, 78 on the glass layer 16*a*. Test probes may be used to supply/read test signals to/from the electronic pads 76, 78 via the connections $77_1$, $77_2$. Alternatively, the glass layer 12*a* may be wire bonded to the pads 76, 78 and test connections may be made through an electrical connector.

Testing the package allows the package to be screened for defects before additional manufacturing costs are incurred.

Figure 4:
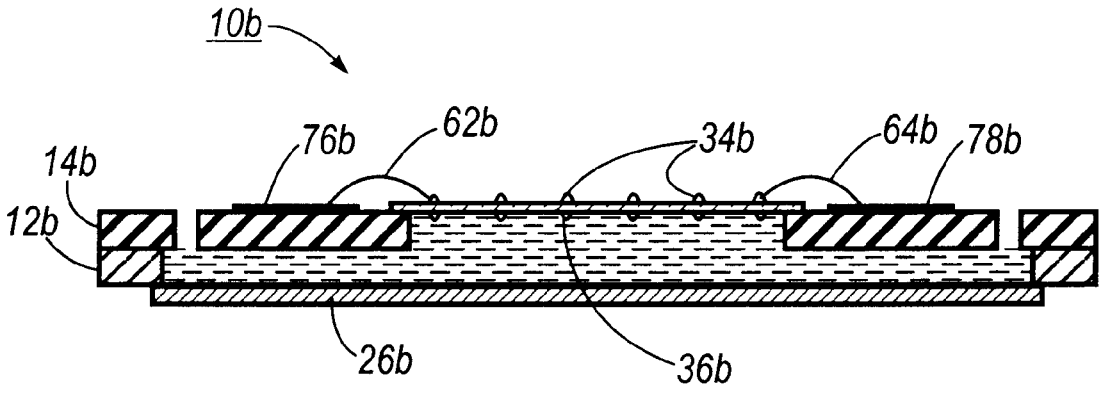
FIG. 4 illustrates a cross-sectional view of an integrated printhead according to a third embodiment of the present invention.

FIG. 4 illustrates a third embodiment of the present invention. For ease of understanding this embodiment, like components are designated by like numerals followed by a (b) and new components are designated by new numerals.

The printhead 10*b* illustrated in FIG. 4 includes two (2) layers 12*b*, 14*b* of the electrically nonconductive material. In this embodiment, the aperture plate 26*b* includes a metal material and serves as one wall of the reservoir 28*b*. Because the printhead 10*b* illustrated in FIG. 4 has only two (2) layers 12*b*, 14*b*, it has the advantage of being thinner than the printheads disclosed in the previous embodiments.

Alternatively, one of the electrically nonconductive layers 14*b* includes electrically conductive patterned traces 76*b*, 78*b*. The wire bonds 62*b*, 64*b* are electrically connected to the traces 76*b*, 78*b*.

Figure 5:
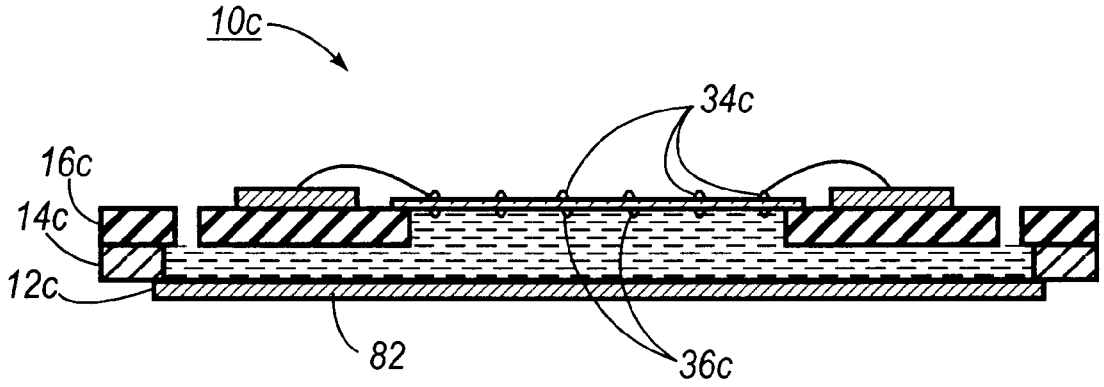
FIG. 5 illustrates a cross-sectional view of an integrated printhead according to a fourth embodiment of the present invention.

FIG. 5 illustrates a fourth embodiment of the present invention. For ease of understanding this embodiment, like components are designated by like numerals followed by a (c) and new components are designated by new numerals.

The printhead 10*c* illustrated in FIG. 5 includes three (3) layers 12*c*, 14*c*, 16*c* of the electrically nonconductive material. In this embodiment, the aperture plate 82 is formed from one (1) of the layers 12*c* of the electrically nonconductive material. Preferably, the layer 12*c* is molded ceramic. It is to be understood that the printhead 10*c* may include additional layers of materials (and process steps) for tailoring the aperture details to the specific designs. As in the previous embodiment, the aperture plate 82 serves as one wall of the reservoir 28*c*.

Figure 6:
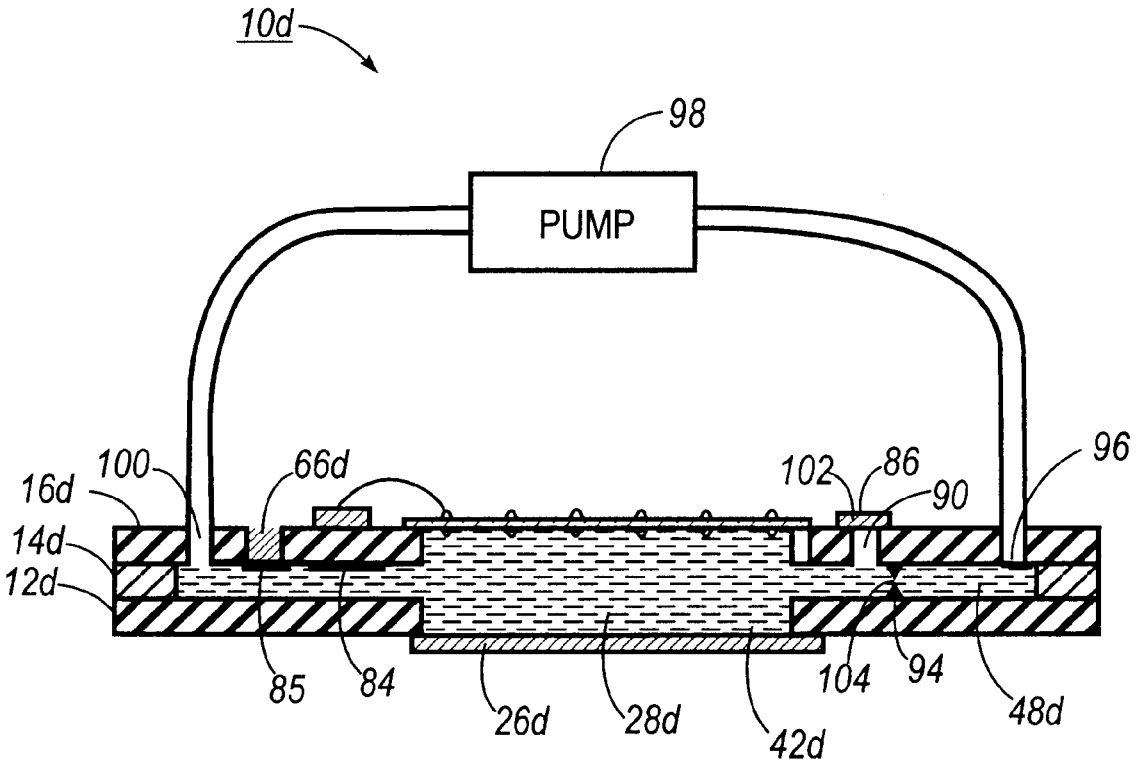
FIG. 6 illustrates a cross-sectional view of an integrated printhead according to a fifth embodiment of the present invention.

FIG. 6 illustrates a fifth embodiment of the present invention. For ease of understanding this embodiment, like components are designated by like numerals followed by a (d) and new components are designated by new numerals.

The printhead 10*d* illustrated in FIG. 6 includes three (3) layers 12*d*, 14*d*, 16*d* of the electrically nonconductive material. As in the embodiment illustrated in FIG. 4, the aperture plate 26*d* includes a metal material.

In the embodiment shown in FIG. 6, a temperature sensor 84 is integrated into the printhead 10*d*. A heater/cooler 85 controls the temperature of the fluid 42*d* as a function of data obtained from the temperature sensor 84. An electrical connection 66*d*, such as a conventional via, provides electrical paths to the temperature sensor 84 and heater/cooler 85 from external electronics.

In the embodiment shown in FIG. 6, the heater/cooler 85 is integrated inside the printhead 10*d*. However, it is also contemplated that the heater/cooler 85 be integrated on an exterior surface of the printhead 10*d*. Alternatively, the electrically nonconductive material 12*d*, 14*d*, 16*d* contacts an external heater. Heat is then transferred to the fluid via the nonconductive material 12*d*, 14*d*, 16*d*. If the electrically nonconductive layers include a positive temperature coefficient ("PTC") material, the temperature of the PTC material increases, as heat is supplied from the external heater, to a cutoff point. Once the cutoff point is reached, heat escapes through exposed portions of the PTC material. In this manner, the PTC material acts as a self regulating temperature component for the printhead.

Optionally, a pressure sensor 86 is integrated into the passage 90, which communicates with a common passage 48*d*. The pressure sensor 86 measures the pressure of the fluid 42*d*. Furthermore, a flow measurement device 94 is integrated into the common passage 48*d*. The fluid 42*d* enters the reservoir 28*d* through the common passage 48*d*.

Optionally, a variable flow constriction device 96 is integrated into the common passage 48*d*. The variable flow constriction device 96 controls the flow of the fluid 42*d*, to achieve an optimal flow rate, as a function of data received from the flow sensor 94 and/or the pressure sensor 86. It is also contemplated to modulate the rate at which the pump 98 introduces the fluid 42*d* into the printhead 10*d* as a function of the flow sensor 94 data.

In the embodiment shown in FIG. 6, the variable flow constriction device 96 is a membrane that forms part of the passage wall of 48*d*. The membrane 48*d* changes shape to alter the flow resistance through the passage 48*d*. Alternatively, the flow constriction device 96 is a bimetallic strip having an expansion feature.

In this manner, the flow rate of the fluid 42*d* is sensed and controlled by devices which are integrated into the printhead, thereby reducing the need for external modular components.

It is to be understood that the temperature sensor 84, pressure sensor 86, flow sensor 94, heater/cooler 85, and flow constriction device 96 may be located anywhere in the printhead 10*d* for measuring temperature, pressure and determining flow rates. Although the temperature sensor 84, pressure sensor 86, flow sensor 94, heater/cooler 85, and flow constriction device 96 have been described as being integrated into the printhead 10*d*, it is also contemplated that external components or components built onto the printhead be used. Furthermore, it is also contemplated that electronic sensors and controllers be connected to the printhead via removable connectors (e.g., plugs). While the preferred embodiment includes standard components, bimetallic or self-regulating components are also contemplated.

It is also contemplated that the heater/cooler 85 and flow constriction device 96 control the temperature, flow, and pressure of the fluid 48*d* as a function of data supplied from a printing device indicating future printer demands.

It is to be understood that temperature, pressure, and flow sensing/control may also be used in passages carrying cooling fluids.

In an alternate embodiment, it is also contemplated to integrate appropriately sized valves and electronics into the printhead for controlling the flow rate of the fluid. Such valves and electronics are commonly available.

Although the integrated printhead has been described with reference to an acoustic ink printing device, it is to be understood that other integrated printhead designs, for use in other types of printers, are also contemplated.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An integrated printhead, comprising:

a housing;

a reservoir defined in the housing for containing a first fluid;

a plate for covering an open side of the reservoir, the plate having apertures for passing the first fluid from the reservoir to the exterior of the housing;

a plurality of passages formed within the housing, at least one of the passages communicating with the reservoir;

a temperature sensor within the housing for measuring a temperature of the first fluid; and a substrate, within the reservoir, for causing the first fluid to be ejected from the reservoir.

2. The integrated printhead as set forth in claim 1, wherein the housing includes a ceramic material.

3. The integrated printhead as set forth in claim 1, further including:

an acoustic generator, secured to the substrate, for producing acoustic sound waves within the reservoir; and at least one lens, secured to the substrate, for focusing the acoustic sound waves toward the aperture plate, each lens being associated with one of the acoustic generators.

4. The integrated printhead as set forth in claim 1, further including:

electronics integrated into the housing.

5. The integrated printhead as set forth in claim 4, further including:

an electrical connection for testing the electronics.

6. The integrated printhead as set forth in claim 1, further including:

a second reservoir containing a gas and a portion of the fluid, the gas acting as a dampener for absorbing vibrations and shocks in the fluid.

7. The integrated printhead as set forth in claim 1, further including:

a second cover surrounding the substrate, a second fluid passing through apertures in the second cover for cooling the first fluid.

8. The integrated printhead as set forth in claim 1, further including:

a pressure sensor for measuring a pressure of the first fluid.

9. The integrated printhead as set forth in claim 1, further including:

a temperature controller device, electrically connected to the temperature sensor, for controlling a temperature of the first fluid as a function of data received from the temperature sensor.

10. The integrated printhead as set forth in claim 1, further including:

a flow sensor; and a flow controller for controlling a flow of the first fluid as a function of data received from the flow sensor.

11. The integrated printhead as set forth in claim 1, wherein the housing includes a double shot plastic material.

12. The integrated printhead as set forth in claim 11, wherein the double shot plastic includes two intertwined networks of plastic, and wherein at least one of the two intertwined networks of plastic is plateable.

13. A method of printing with an integrated ink printhead including a reservoir for containing a first fluid, a plate for covering an opening of the reservoir, the plate having apertures for passing the first fluid from the reservoir to the exterior of the printhead, a substrate carrying at least one transducer on a first side of the substrate and at least one acoustic lens on a second side of the substrate, the second side of the substrate being within the reservoir and in contact with the first fluid, a plurality of passages, at least one of the passages being a fluid passage communicating with the reservoir and the exterior of the printhead, the method comprising:

injecting the first fluid into the reservoir via the fluid passage; and ejecting the first fluid through at least one of the apertures in the plate.

14. The method of printing with an integrated ink printhead as set forth in claim 13, wherein the integrated printhead includes a plurality of layers including a non-conductive material, a substrate covers a second opening of the reservoir, and a second cover, including apertures, surrounds the substrate, the method further including:

passing a second fluid through the apertures in the second cover for cooling the first fluid.

15. The method of printing with an integrated ink printhead as set forth in claim 13, wherein at least one temperature sensor is secured within the at least one reservoir passage and at least one temperature controller device is electrically connected to the at least one temperature sensor and secured within the at least one reservoir passage, the method further including:

controlling a temperature of the fluid by adjusting the temperature controller device as a function of data received from the at least one temperature sensor.

16. The method of printing with an integrated ink printhead as set forth in claim 13, further including a flow sensor and a flow controller electrically connected to the flow sensor, the method further including:

measuring a flow of the fluid within the passage via the flow sensor; and activating the flow controller as a function of data received from the flow sensor for controlling the flow of the fluid in the passage.

17. The method of printing with an integrated ink printhead as set forth in claim 13, further including a pressure sensor and a pressure controller electrically connected to the pressure sensor, the method further including:

measuring a pressure of the fluid within the passage via the pressure sensor; and activating the pressure controller as a function of data received from the pressure sensor for controlling the pressure of the fluid in the passage.

18. An integrated printhead package for acoustic ink printing, comprising:

a plurality of layers, each of the layers being stacked against one of the other layers;

a reservoir defined within the layers, for containing a first fluid, one of the layers forming a plate for covering an open side of the reservoir, the plate having apertures for passing the first fluid from the reservoir to an exterior area;

a passage, formed by at least one of the stacked layers, communicating with the reservoir and the exterior area, the first fluid passing through the passage;

a flow sensor; and a flow controller operative to control a flow of the first fluid as a function of data received from the flow sensor.

19. The integrated printhead package for acoustic ink printing as set forth in claim 18, further including:

a temperature sensor and the flow sensor within the passage; and a temperature controller device and a flow controller for controlling a temperature, and a flow of the first fluid within the at least one passage as a function of data received from the temperature sensor, the flow sensor, and the pressure sensor.

20. The integrated printhead package for acoustic ink printing as set forth in claim 19, wherein the temperature controller and flow controller control the temperature, flow, and pressure of the first fluid as a function of data supplied from a printing device indicating future printer demands.

21. An integrated printhead, comprising:

a housing;

a reservoir defined in the housing for containing a first fluid;

a plate for covering an open side of the reservoir, the plate having apertures for passing the first fluid from the reservoir to the exterior of the housing;

a plurality of passages formed within the housing, at least one of the passages communicating with the reservoir;

a temperature sensor within the housing for measuring a temperature of the first fluid;

a temperature controller within the housing connected to the temperature sensor, for controlling a temperature of the first fluid as a function of data received from the temperature sensor; and a substrate operative as a wall of the reservoir and operative to support transducers which are operative to selectively eject fluid from the reservoir through the apertures.

22. The integrated printhead as set forth in claim 21, wherein the temperature controller and flow controller control the temperature and flow of the first fluid as a function of data supplied from a printing device indicating future printer demands.

* * * * *